United States Patent [19]

Thevenon

[11] Patent Number: 4,535,946

[45] Date of Patent: Aug. 20, 1985

[54] FIXED POSITION MACHINE FOR COILING DOWN A CABLE

[76] Inventor: Henri Thevenon, Lyons, France

[21] Appl. No.: 616,762

[22] Filed: Jun. 4, 1984

[30] Foreign Application Priority Data

Jun. 3, 1983 [FR] France ..... 83 09228

[51] Int. Cl.[3] ..... E21B 19/00; B21C 47/00; B65H 75/36; B65H 54/76

[52] U.S. Cl. ..... 242/54 R; 242/82; 254/134.3 R; 254/382

[58] Field of Search ..... 242/54 R, 82, 83, 85, 242/85.1; 254/134.3 R, 134.35 C, 382, 400

[56] References Cited

U.S. PATENT DOCUMENTS

| | | | |
|---|---|---|---|
| 1,735,301 | 11/1929 | Short | 254/134.3 R |
| 2,806,380 | 9/1957 | Martin | 254/134.3 R |
| 2,996,231 | 8/1961 | Gretter | 254/134.35 C X |
| 3,154,157 | 10/1964 | Anderson | 242/82 |
| 3,394,920 | 7/1968 | Pomeroy | 254/134.3 R |
| 4,145,014 | 3/1979 | Chatard | 242/54 R X |
| 4,324,195 | 4/1982 | Cunningham | 242/54 R X |

FOREIGN PATENT DOCUMENTS

| | | | |
|---|---|---|---|
| 1272531 | 7/1960 | France . | |
| 1428176 | 2/1965 | France . | |
| 88593 | 9/1965 | France . | |
| 2362783 | 8/1977 | France . | |
| 325337 | 3/1972 | U.S.S.R. | 242/83 |

*Primary Examiner*—Stuart S. Levy
*Assistant Examiner*—Lloyd D. Doigan
*Attorney, Agent, or Firm*—Sughrue, Mion, Zinn, Macpeak & Seas

[57] ABSTRACT

A fixed position machine for coiling down a cable (8) in successive layers inside a tank (1) comprises a horizontal arm (12) rotatably mounted on a column situated (11) on the axis of the tank. The cable to be coiled down passes under the tank and round an inlet curve (22) fitted with rolls (21) to pass up through the column, over a fixed guide pulley (15) at the top of the column to deflect the cable to run horizontally along the arm, and then over a moving pulley (16) which is movable along the arm to direct the cable coming from the fixed guide pulley down into the tank above any point between the sides of the tank. Such a machine is mainly for coiling down electric cable in very long single-piece lengths and in tanks with little head room.

4 Claims, 1 Drawing Figure

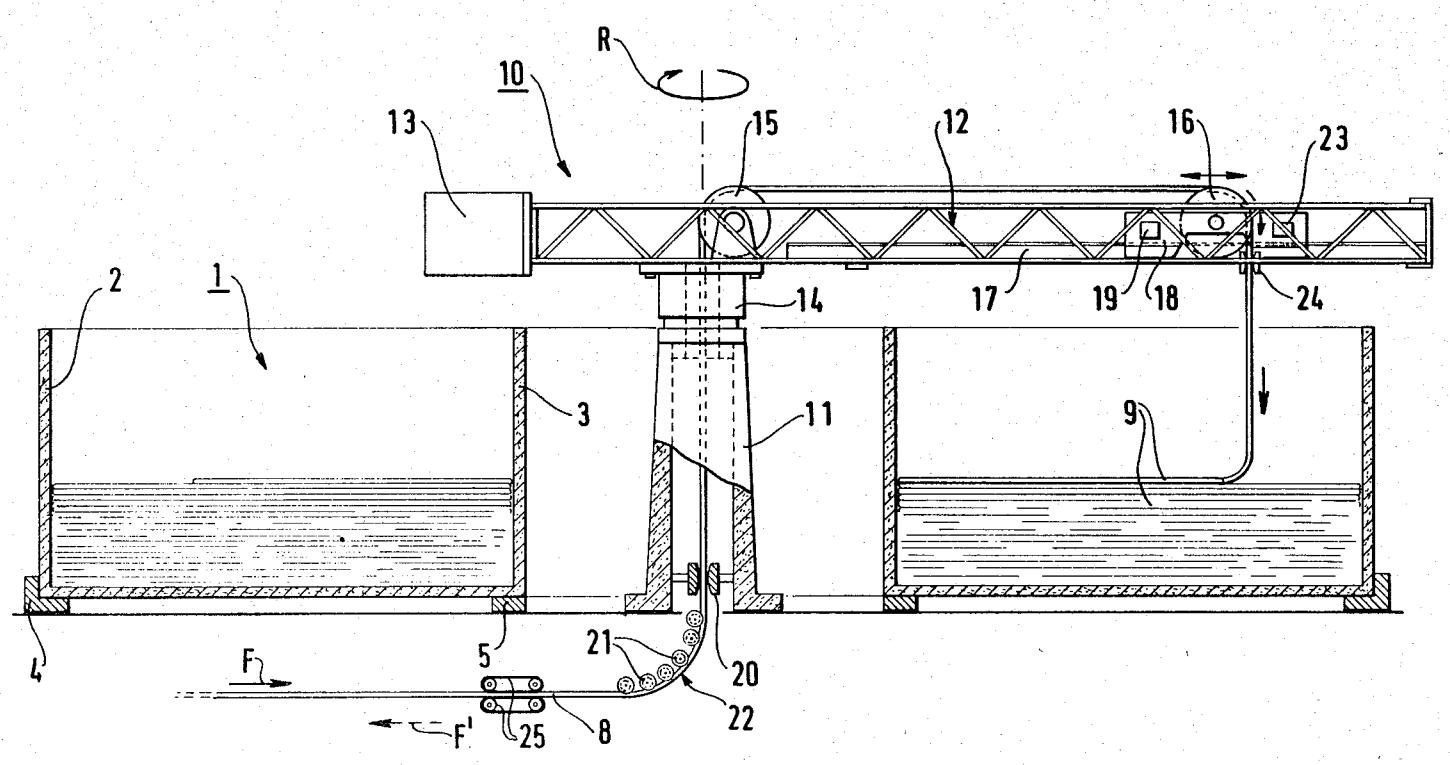
23
24
16
18
19
9
17
12
14
11
15
20
22
R
21
8
10
3
25
5
F'
13
F
1
2
4

FIXED POSITION MACHINE FOR COILING DOWN A CABLE

The present invention relates to a fixed position machine for coiling down a cable in successive layers in a tank.

BACKGROUND OF THE INVENTION

Electrical cables which are manufactured and delivered in very long one-piece lengths cannot be wound on drums since the drums would be exorbitant in size.

They are therefore stored in storage tanks.

While it is being coiled down, the cable is subjected to a twist of one turn about its longitudinal axis per spiral turn in the tank. Such twist degrades the internal structure of the cable so efforts are made to reduce it by increasing the average diameter of the turns.

While the coil is being uncoiled the height of the guide point of the cable is raised, which guide point is usually on a pulley which is fitted with a guide hole for guiding the cable into the vertical axis of the tank.

The machines and devices generally used have a guide point which is very high above the tank in order to facilitate uncoiling. They therefore tend to have a coiling arm which is either sloping or else mounted on a parallelogram linkage. Such machines are thus very tall and difficult to integrate in a conventional workshop or in the hold of a cable ship.

Preferred embodiments of the present invention enable this drawback of excessive height to be avoided, while still ensuring that twist is properly distributed along the cable.

SUMMARY OF THE INVENTION

The present invention provides a fixed position machine for coiling down a cable in successive layers inside a tank, said machine comprising:

- a horizontal arm rotatably mounted on a column situated on the axis of the tank;
- means for passing a cable to be coiled down under the tank and round an inlet curve fitted with rolls to pass up through the column;
- a guide pulley to deflect the cable to run horizontally along the arm after emerging from the top of the column; and
- a moving pulley which is movable along the arm to direct the cable coming from the said guide pulley down into the tank above any point between the sides of the tank.

Advantageously the the moving pulley is mounted on a carriage which is driven along the horizontal arm by a motor, and the moving pulley is rotated by another motor.

Preferably, the moving pulley is a drive pulley and is in the form of a sheave having a V-shaped groove for pinching the cable to drive it.

In another embodiment, an endless belt provides the main cable-driving force, with the drive pulley serving to keep the cable taut from the downstream end of the endless belt to the drive pulley.

Advantageously, the rolls constituting the inlet curve are in the form of sheaves with elastomer-lined grooves to prevent cable twist from passing upstream from the rolls.

BRIEF DESCRIPTION OF THE DRAWING

An embodiment of the invention is described by way of example with reference to the accompanying drawing in which the sole FIGURE is a side view partially in section of a coiling down machine in accordance with the invention.

MORE DETAILED DESCRIPTION

A tank 1 has a circular outer wall 2 and a circular inner wall 3. The tank stands on inner and outer blocks 4 and 5. The coiling down machine 10 is mounted in the center of the tank and comprises a central column 11 through which the cable 8 to be coiled down is passed, and a horizontal arm 12 which is pivoted at 14 on the column 11 to rotate in a horizontal plane above the tank 1. One end of the arm 12 has a counterweight 13, the central portion of the arm has a fixed position guide pulley and the remainder of the arm has a moving pulley 16 which is moved back and forth along the arm by a carriage 18 running on a guide rail 17 and supporting the shaft of the pulley 16. The carriage is driven by a motor 19.

A motor 23 rotates the pulley 16 which thus becomes a drive pulley for the cable 8. The pulley is in the form of a sheave having a V-shaped groove for pinching to the cable to drive it. The groove may be lined with an elastomer to facilitate cable driving.

The cable is thus driven in the direction of arrow F by the pulley 16 and also by an endless belt 25 with the endless belt providing the greater part of the traction and with the pulley 16 serving to keep the cable taut between the endless belt 25 and the drive pulley 16.

A guide hole 24 over the carriage guides the cable as it leaves the pulley 16 to ensure that the cable cannot jump out of the pulley groove.

The central column 11 includes a second guide hole 20 near its base, and in between the second guide hole 20 and the endless belt 25 there is a set of rolls 21 providing an inlet curve 22.

The rolls 21 are also in the form of sheaves having V-shaped grooves which are lined with elastomer to prevent twist in the cable from being transmitted any further back, ie. to the endless belt 25.

Coiling down takes place as follows:

The cable 8 passes under the tank 1, is guided by the rolls 21 round the inlet curve 22 into the guide hole 20, then passes vertically up the column to the pulley 15 along a variable length of the arm 12 to the moving pulley 16, and finally drops into the tank. To lay one turn of the coil, the horizontal arm is rotated about the tank axis in the direction of arrow R while the drive pulley 16 drives the cable. Once the turn is completed, the carriage 18 is moved along the rail 17 by a distance equal to the thickness of the cable, and it may be moved outwardly or inwardly along the arm depending on the direction in which a particular layer 9 is being coiled down.

An operator inside the tank thrusts the cable against the preceding turn, and pulls or pushes on the cable to rotate the horizontal arm. Rotation of the horizontal arm may naturally be provided by an operator's assistant or by a motor.

While uncoiling, the cable is pulled in the direction of arrow F′ by a loading endless belt outside the tank, or by auxiliary tractors, not shown. The drive pulley 16 and the horizontal arm are left to rotate freely while an operator adjusts the position of the carriage 18 from side to side of the tank and for each layer.

Without going beyond the scope of the invention, the machine may naturally be fully or partially automated.

I claim:

1. A fixed position machine for coiling down a cable in successive layers inside a circular tank having a vertical axis, said machine comprising:

a hollow column vertically situated on the axis of the tank, a horizontal arm mounted for rotation on said column above said tank;

means including an inlet curve of fitted rolls, for passing a cable to be coiled down under the tank and around said inlet curve of fitted rolls and up through the hollow column;

a guide pulley mounted at a fixed location on said arm for rotation about a horizontal axis above said column, said cable passing up through said hollow column being leaved about said guide pulley such that said guide pulley deflects the cable to cause it to run horizontally along the arm after emerging from the top of the column;

a carriage mounted on said arm for movement horizontally along said arm towards and away from said guide pulley, said carriage including a motor for driving said carriage along said horizontal arm;

a drive pulley mounted to said carriage for rotation about a horizontal axis at the level of said guide pulley and being in line therewith and receiving said cable passing over said guide pulley;

a motor on said carriage for rotating said drive pulley about its axis; and said cable passing about said drive pulley and deflected vertically downwardly into said tank at a selectable point within said tank.

2. A coiling down machine according claim 1, wherein the drive pulley is in the form of a sheave having a V-shaped groove for pinching the cable to drive the cable.

3. A coiling down machine according to claim 1, further including an endless belt engaging said cable upstream of said fitted rolls for driving the cable upwardly through said hollow column, and wherein said drive pulley serves to keep cable taut from the downstream end of the endless belt to the drive pulley.

4. A coiling down machine according to claim 1, wherein the rolls constituting the inlet curve are in the form of sheaves with elastomer-lined grooves to prevent cable twist from passing upstream from the rolls.

* * * * *